US007940221B2

(12) United States Patent
Chen et al.

(10) Patent No.: US 7,940,221 B2
(45) Date of Patent: May 10, 2011

(54) ELECTRONIC DEVICE AND TELESCOPIC ANTENNA MODULE

(75) Inventors: Hen-An Chen, Taipei (TW); Chih-Ming Wang, Taipei (TW)

(73) Assignee: Wistron NeWeb Corp., Hsinchu (TW)

( * ) Notice: Subject to any disclaimer, the term of this patent is extended or adjusted under 35 U.S.C. 154(b) by 385 days.

(21) Appl. No.: 12/336,446

(22) Filed: Dec. 16, 2008

(65) Prior Publication Data

US 2009/0256760 A1 Oct. 15, 2009

(30) Foreign Application Priority Data

Apr. 10, 2008 (TW) ..... 97112996 A

(51) Int. Cl.
*H01Q 1/24* (2006.01)

(52) U.S. Cl. ..... 343/702; 343/906

(58) Field of Classification Search ..... 343/702, 343/848, 906
See application file for complete search history.

(56) References Cited

U.S. PATENT DOCUMENTS

| | | | | |
|---|---|---|---|---|
| 5,918,163 | A * | 6/1999 | Rossi | 455/558 |
| 6,266,017 | B1 * | 7/2001 | Aldous | 343/702 |
| 6,292,148 | B1 * | 9/2001 | Matsuura et al. | 343/702 |
| 6,400,931 | B1 * | 6/2002 | Inkinen et al. | 455/90.1 |

* cited by examiner

*Primary Examiner* — Tan Ho

(57) ABSTRACT

An electronic device and a telescopic antenna module are disclosed. The electronic device includes a housing and the telescopic antenna module. The telescopic antenna module includes an antenna with a ground terminal, a telescopic support with a sliding mechanism and an antenna module shell. The antenna is movably connected to the sliding mechanism. The antenna module shell is made of conductive material. The antenna is connected to the antenna module shell via the ground terminal for ground connection.

14 Claims, 5 Drawing Sheets

ELECTRONIC DEVICE AND TELESCOPIC ANTENNA MODULE

CROSS REFERENCE TO RELATED APPLICATIONS

This Application claims priority of Taiwan Patent Application No. 97112996, filed on Apr. 10, 2008, the entirety of which is incorporated by reference herein.

BACKGROUND OF THE INVENTION

1. Field of the Invention

The invention relates to an electronic device and a telescopic antenna module.

2. Description of the Related Art

A conventional telescopic antenna module comprises an antenna and a telescopic support. During assembly of the conventional telescopic antenna module with an electronic device including a metal shell, a ground terminal is connected to the metal shell via the metal shell for ground connection. Meanwhile, if the conventional telescopic antenna module is applied to an electronic device with a plastic shell, the electronic device additionally comprises a metal ground terminal and a copper foil built thereon because the plastic shell does not provide ground connection. Specifically, the copper foil is connected to the metal ground terminal and the ground terminal of the antenna. The copper foil enables the ground terminal of the antenna to connect to the metal ground terminal of the electronic device for ground connection.

However, if the conventional telescopic antenna module is assembled with electronic devices with various materials, the structures of the electronic devices are re-designed according to their specific material, resulting in design inconvenience. Moreover, costs are substantially increased as different designs need additional molding and copper foil.

BRIEF SUMMARY OF THE INVENTION

The invention provides an electronic device and a telescopic antenna module. The electronic device includes a housing and the telescopic antenna module. The telescopic antenna module includes an antenna with a ground terminal, a telescopic support with a sliding mechanism and an antenna module shell. The antenna is movably connected to the sliding mechanism. The antenna module shell is made of conductive material. The length of the antenna module shell ranges between 130 mm and 200 mm, and the width of the antenna module shell ranges between 35 mm and 50 mm. The antenna is connected to the antenna module shell via the ground terminal for ground connection.

Note that the telescopic support further comprises a hole. The ground terminal passes through the hole and is then connected to the antenna module shell.

Note that the ground terminal comprises a metal flexible sheet.

Note that the antenna further comprises a first signal contact. The telescopic support further comprises a second signal contact. The first signal contact maintains connection with the second signal contact during movement of the antenna corresponding to the telescopic support.

Note that the antenna module shell comprises a fixed hole. The telescopic support further comprises a fastened hole. The antenna module shell is connected to the telescopic support via the fixed hole and the fastened hole.

Note that the antenna module shell comprises a ground protrusion. The ground protrusion is connected to the ground terminal of the antenna.

The electronic device comprises a housing and the above-mentioned telescopic antenna module.

The invention can be more fully understood by reading the subsequent detailed description and examples with references made to the accompanying drawings, wherein:

DETAILED DESCRIPTION OF THE INVENTION

Figure 1:
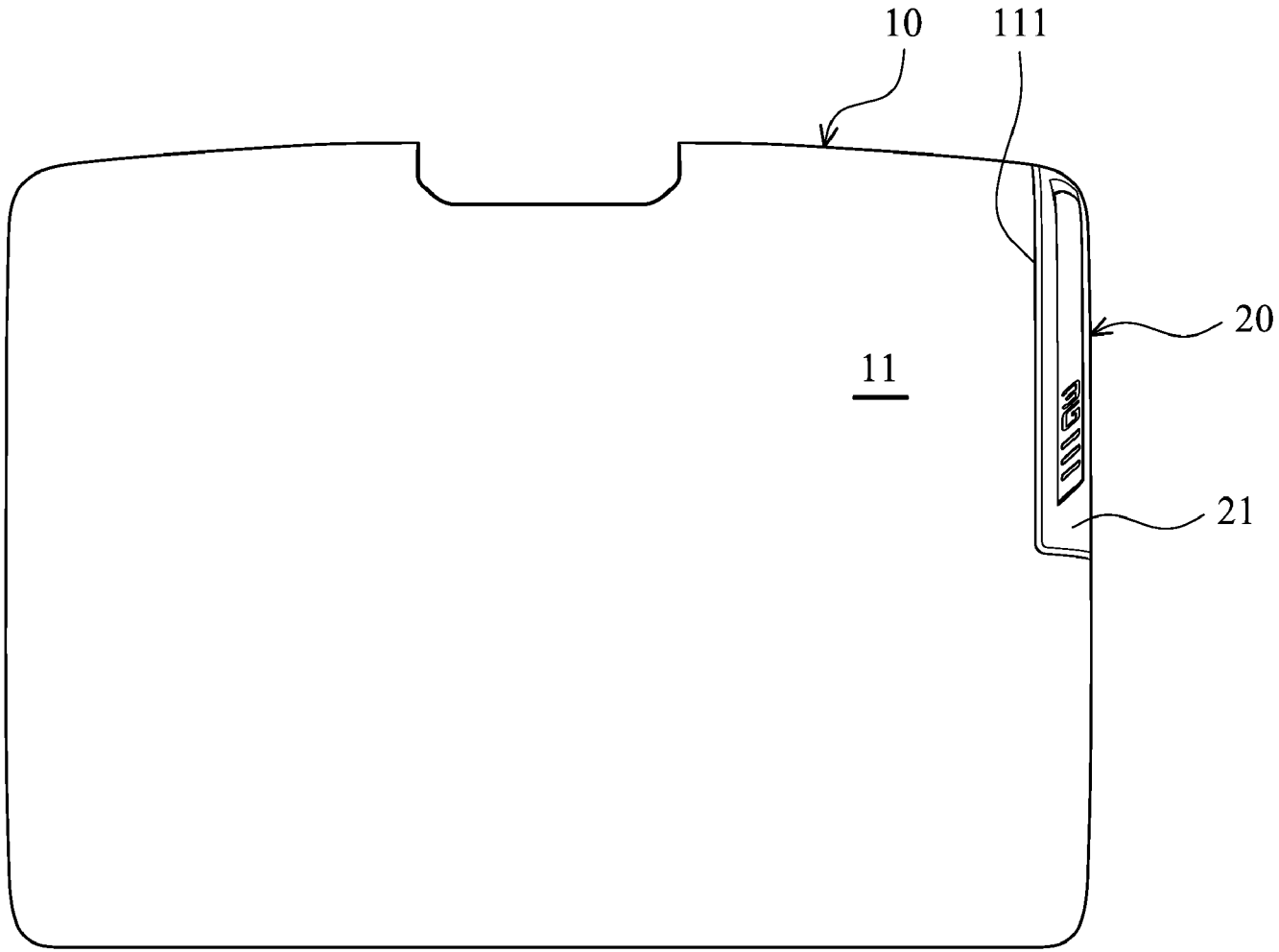
FIG. 1 is a schematic view of a telescopic antenna module assembled with an electronic device according to an embodiment of the invention.

FIG. 1 is a schematic view of a telescopic antenna module assembled with an electronic device according to an embodiment of the invention. The electronic device 11 comprises a housing 10. The housing 11 is cut to form a space 111 corresponding to the size of the telescopic antenna module 20. The telescopic antenna module 20 independently provides ground connection, thus, the telescopic antenna module 20 can be directly assembled with the electronic device 10 with various materials, without consideration of ground connection, and without changing the structure of the electronic device 10. Note that the telescopic antenna module 20 is connected to the housing 11 via screws or adhesive. The length L of an antenna module shell 21 of the telescopic antenna module 20 ranges between 130 mm and 200 mm. The width W of the antenna module shell 21 of the telescopic antenna module 20 ranges between 35 mm and 50 mm.

Figure 2:
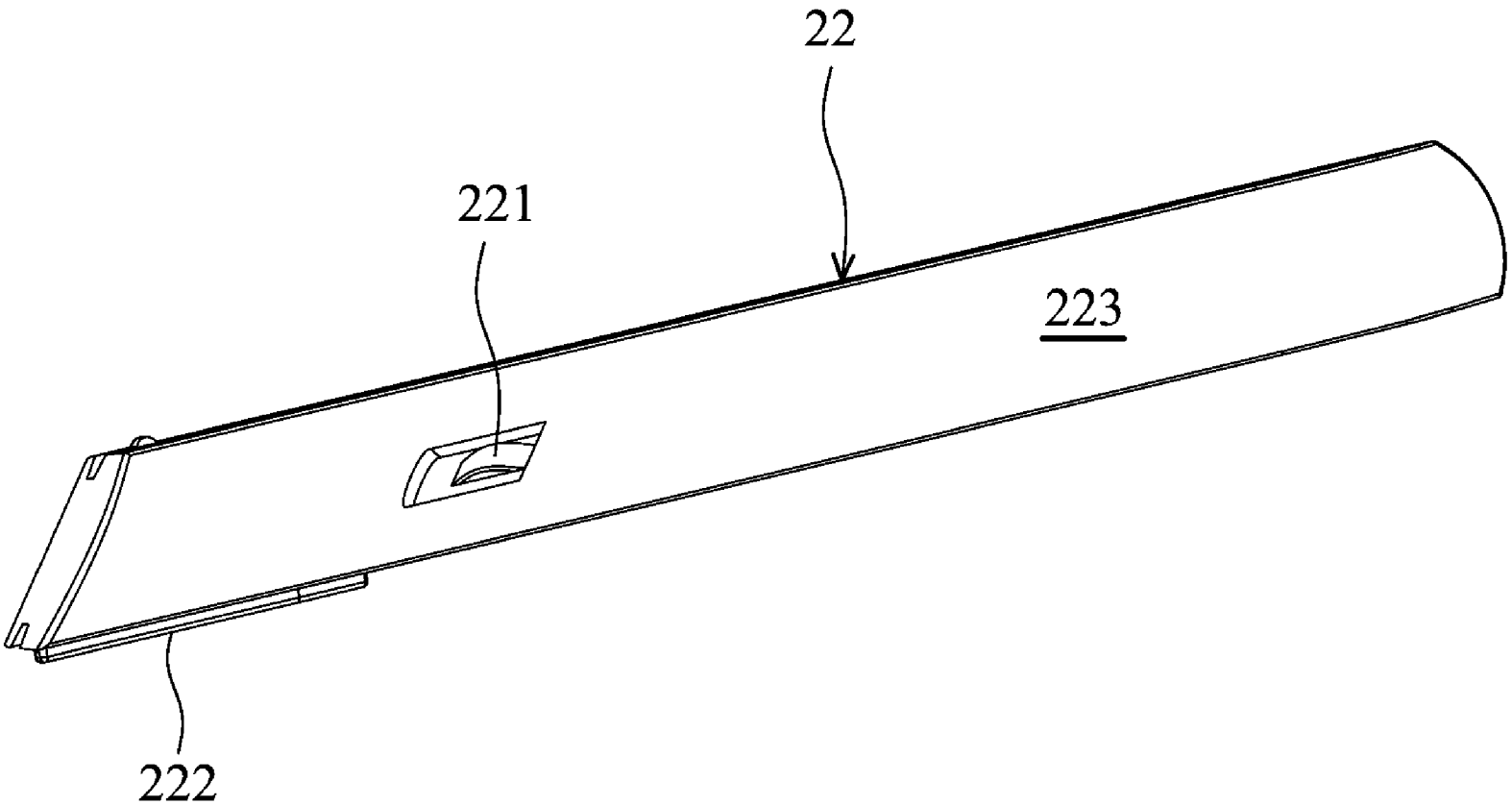
FIG. 2 is a schematic view of an antenna according to an embodiment of the invention.
Figure 3:
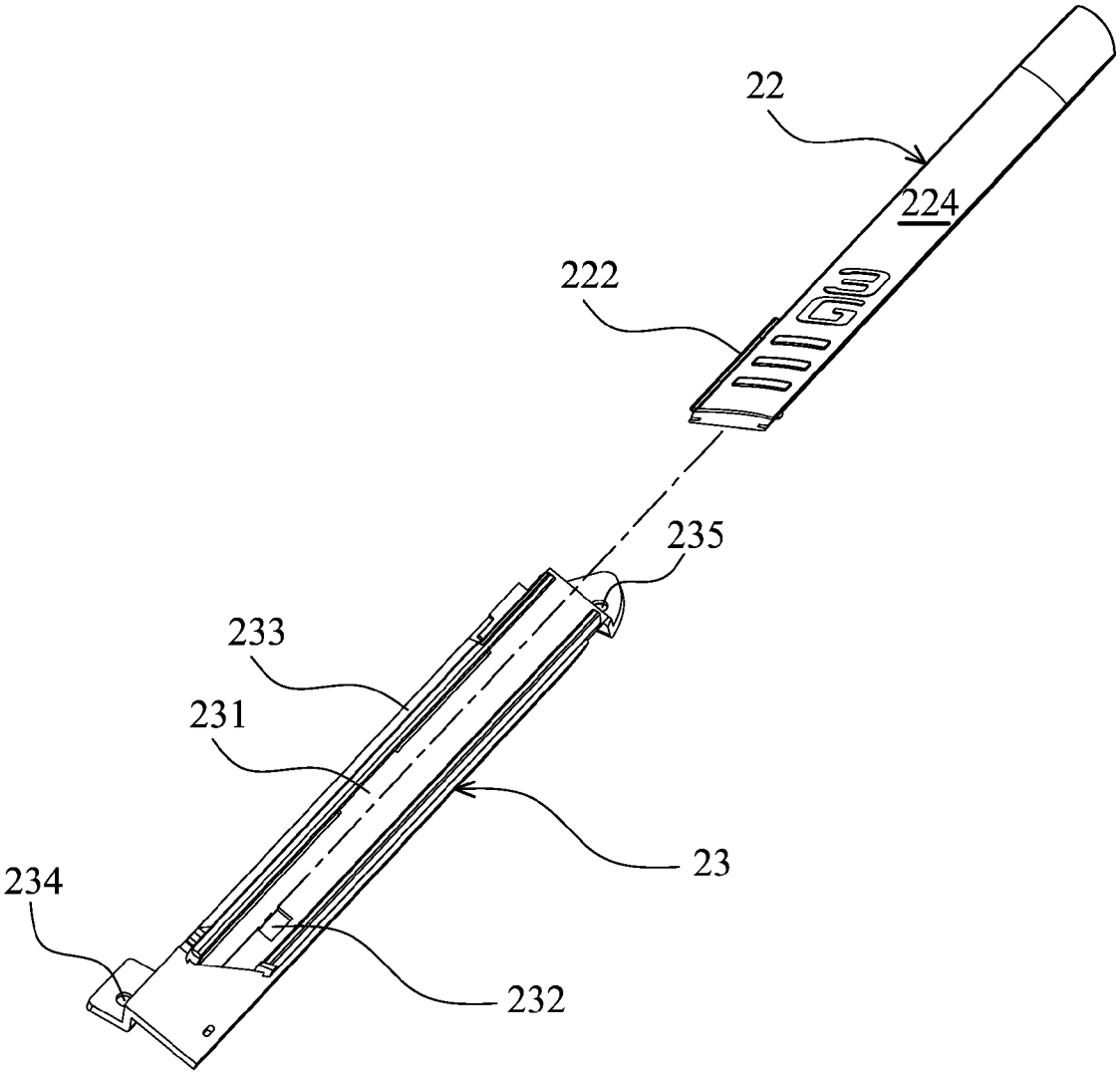
FIG. 3 is an exploded view of an antenna and a telescopic support according to an embodiment of the invention.
Figure 4A:
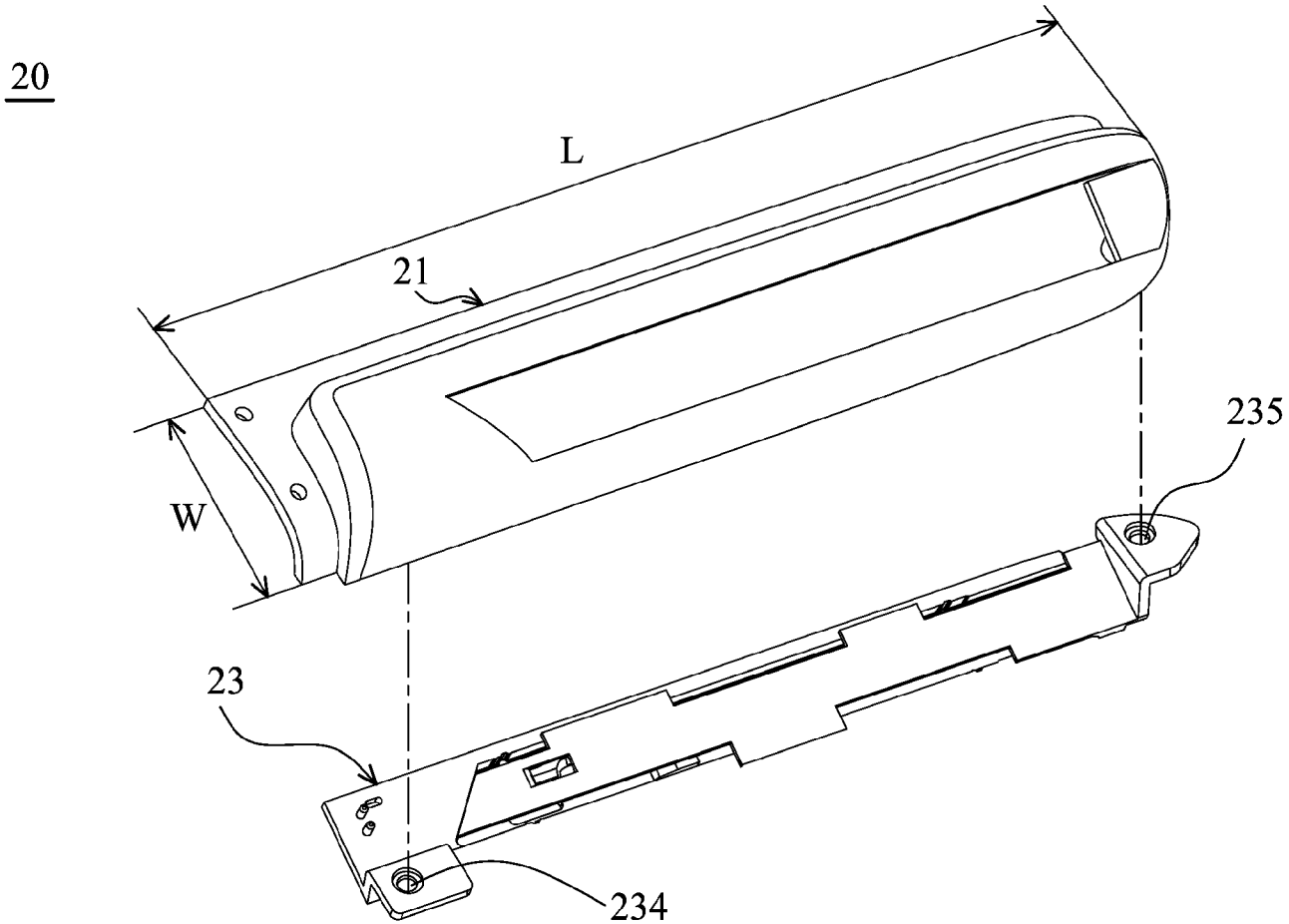
FIG. 4*a* is a schematic view showing assembly of a telescopic antenna module according to an embodiment of the invention.
Figure 4B:
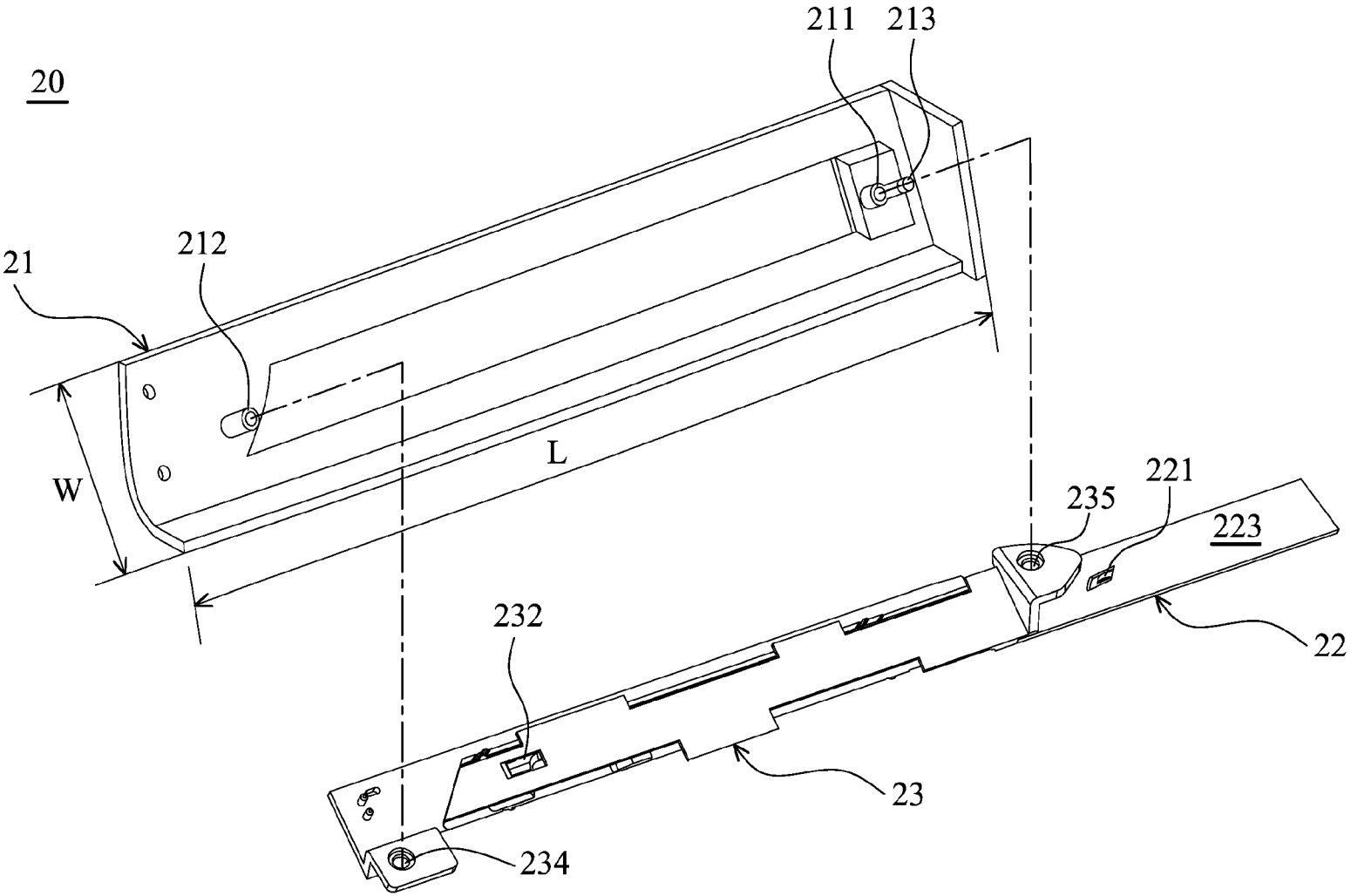
FIG. 4*b* is a schematic view from another angle of showing assembly of a telescopic antenna module according to an embodiment of the invention.

Referring to FIGS. 2-4*b*, FIG. 2 is a schematic view of an antenna according to an embodiment of the invention, FIG. 3 is an exploded view of an antenna and a telescopic support according to an embodiment of the invention, FIG. 4*a* is a schematic view showing assembly of a telescopic antenna module according to an embodiment of the invention, and FIG. 4*b* is a schematic view from another angle showing assembly of a telescopic antenna module according to an embodiment of the invention. The telescopic antenna module 20 comprises an antenna 22, a telescopic support 23 and an antenna module shell 21. Referring to FIGS. 2 and 3, the antenna 22 comprises a first surface 223, a second surface 224, a ground terminal 221 and a first signal contact 222. The ground terminal 221 and the first signal contact 222 are disposed on the first surface 223. When the antenna 22 is inserted into the telescopic support 23, the first surface 223 is connected to the telescopic support 23. In this embodiment, the first signal contact 222 is a metal flexible sheet.

The telescopic support 23 comprises a sliding mechanism 231, a second signal contact 233, a hole 232 and two fastened holes 234 and 235. The antenna 22 is movably disposed on the sliding mechanism 231. When the antenna 22 reverts back to the sliding mechanism 231, the ground terminal 221 of the antenna 22 protrudes from the hole 232 and then connects to the antenna module shell 21 (shown in FIG. 4*a*) for ground connection. The first signal contact 222 of the antenna 22 connected to the sliding mechanism 231 maintain electrical connection to the second signal contact 233. The second signal contact 233 is electrically connected to the electronic device 10 (not shown).

Referring to FIGS. 4*a* and 4*b*, the antenna module shell 21 comprises two fixed holes 211 and 212, and a ground protrusion 213. The fixed holes 211 and 212 correspond to and are connected to the fastened holes 235 and 234. Then, the antenna module shell 21 is fixed on the telescopic support 23 via a fixing element (not shown). Shown in FIG. 4*b*, the ground protrusion 213 of the antenna module shell 21 is connected to the ground terminal 221 of the antenna 22 for ground connection.

The telescopic antenna module 20 independently provides ground connection, thus, the telescopic antenna module 20 can be directly assembled with the electronic device with various materials, without consideration of ground connection, and without changing the structure of the electronic device, thus decreasing costs.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A telescopic antenna module, installed on an electronic device, comprising:

an antenna comprising a ground terminal;

a telescopic support comprising a sliding mechanism, and the antenna movably connected to the sliding mechanism; and an antenna module shell, wherein the antenna module shell is made of conductive material, the length of the antenna module shell ranges between 130 mm and 200 mm, the width of the antenna module shell ranges between 35 mm and 50 mm, and the antenna is connected to the antenna module shell via the ground terminal for ground connection.

2. The telescopic antenna module as claimed in claim 1, wherein the telescopic support further comprises a hole, and the ground terminal passes through the hole and is then connected to the antenna module shell.

3. The telescopic antenna module as claimed in claim 1, wherein the ground terminal comprises a metal flexible sheet.

4. The telescopic antenna module as claimed in claim 1, wherein the antenna further comprises a first signal contact, the telescopic support further comprises a second signal contact, and the first signal contact maintains connection with the second signal contact during movement of the antenna corresponding to the telescopic support.

5. The telescopic antenna module as claimed in claim 4, wherein the antenna module shell comprises a fixed hole, the telescopic support further comprises a fastened hole, and the antenna module shell is connected to the telescopic support via the fixed hole and the fastened hole.

6. The telescopic antenna module as claimed in claim 1, wherein the antenna module shell comprises a ground protrusion, and the ground protrusion is connected to the ground terminal of the antenna.

7. An electronic device, comprising:

a housing; and a telescopic antenna module comprising:

an antenna comprising a ground terminal;

a telescopic support comprising a sliding mechanism, the antenna movably connected to the sliding mechanism; and an antenna module shell, wherein the antenna module shell is made of conductive material, the length of the antenna module shell ranges between 130 mm and 200 mm, the width of the antenna module shell ranges between 35 mm and 50 mm, and the antenna is connected to the antenna module shell via the ground terminal for ground connection.

8. The electronic device as claimed in claim 7, wherein the telescopic support further comprises a hole, and the ground terminal passes through the hole and is then connected to the antenna module shell.

9. The electronic device as claimed in claim 7, wherein the ground terminal comprises a metal flexible sheet.

10. The electronic device as claimed in claim 7, wherein the antenna further comprises a first signal contact, the telescopic support further comprises a second signal contact, and the first signal contact maintains to connect to the second signal contact during the antenna moves corresponding to the telescopic support.

11. The electronic device as claimed in claim 7, wherein the antenna module shell comprises a fixed hole, the telescopic support further comprises a fastened hole, and the antenna module shell is connected to the telescopic support via the fixed hole and the fastened hole.

12. The electronic device as claimed in claim 7, wherein the antenna module shell comprises a ground protrusion, and the ground protrusion is connected to the ground terminal of the antenna.

13. The electronic device as claimed in claim 7, wherein the housing is made of plastic or metal.

14. The electronic device as claimed in claim 7, wherein the telescopic antenna module is connected to the housing via screws or adhesive.

* * * * *